United States Patent [19]

Almond

[11] Patent Number: 4,632,171

[45] Date of Patent: Dec. 30, 1986

[54] COUNTER-GRAVITY CASTING MOLD

[75] Inventor: Roger L. Almond, Saginaw, Mich.

[73] Assignee: General Motors Corporation, Detroit, Mich.

[21] Appl. No.: 654,404

[22] Filed: Sep. 26, 1984

[51] Int. Cl.[4] ..... B22D 18/06

[52] U.S. Cl. ..... 164/255; 164/361; 164/364

[58] Field of Search ..... 164/63, 254, 119, 255, 164/256, 258, 61, 349, 364, 361

[56] References Cited

U.S. PATENT DOCUMENTS

| | | | |
|---|---|---|---|
| 3,608,617 | 9/1971 | Burke | 164/126 |
| 4,076,070 | 2/1978 | Lefebvre et al. | 164/119 |
| 4,340,108 | 7/1982 | Chandley et al. | 164/63 |

FOREIGN PATENT DOCUMENTS

| | | | |
|---|---|---|---|
| 387231 | 8/1961 | Switzerland | 164/254 |

OTHER PUBLICATIONS

Automatic Counter Gravity Casting of Shell Molds, Transactions of the American Foundrymen's Society, 87th Annual Meeting, Apr. 10–15, 1983.

Automatic Counter-Gravity Investment Casting, American Society for Metals, Paper No. 8201-045, Oct. 23–28, 1982.

*Primary Examiner*—Nicholas P. Godici
*Assistant Examiner*—Samuel M. Heinrich
*Attorney, Agent, or Firm*—Lawrence B. Plant

[57] ABSTRACT

A thin-walled, resin-bonded sand, shell mold for the vacuum counter-gravity casting of metal comprising cope and drag halves glued together at a parting line therebetween. The drag includes a flange extending beyond the periphery of the cope which flange has an upper sealing surface formed by a drag-shaping pattern for effecting a seal with the mouth of the vacuum chamber used to fill the mold.

4 Claims, 14 Drawing Figures

PRIOR ART
DRAG

COPE

COUNTER-GRAVITY CASTING MOLD

This invention relates to counter-gravity casting of molten metal and more particularly to a self-supporting, gas-permeable, resin-bonded-sand, thin-walled mold therefor.

BACKGROUND OF THE INVENTION

The counter-gravity casting process involves sealing a gas-permeable mold in the mouth of a vacuum chamber, immersing the underside of the mold in an underlying melt, and evacuating the chamber to draw melt up into the mold through one or more ingates in the bottom thereof. Such a process is exemplified by U.S. Pat. No. 4,340,108 wherein the melt is shaped in a resin-bonded-sand shell mold comprising cope and drag portions sealingly bonded together along a horizontal parting line lying outside the vacuum chamber (i.e., the vacuum chamber engages the cope). Such molds are susceptable to air infiltration at the parting line. Moreover, the outer surface of the cope, in its as-formed condition, is so rough as to make it practically impossible to seal to the mouth of the vacuum chamber. Accordingly, additional processing of the cope, after forming, has been required to flatten its upper surface sufficiently to effect a seal with the vacuum chamber.

It is an object of the present invention to provide an improved counter-gravity-casting, resin-bonded-sand, shell mold wherein the flat sealing surface of the mold adjoining the vacuum chamber is formed concurrently with the rest of the mold (i.e., without additional processing steps) and in such a manner that the molds parting line falls within the vacuum chamber.

It is a further object of the present invention to provide such an improved mold with a labyrinth seal at the parting line to prevent melt from escaping the mold into the vacuum chamber.

These and other objects and advantages of the present invention will become more readily apparent from the description thereof which follows and which is given in conjunction with the several Figures wherein:

FIGS. 1*a–d* and FIGS. 2*a–d* illustrate the prior art dump box method of manufacturing shell mold halves from thermosetting-resin-bonded sand;

Figure 1A:
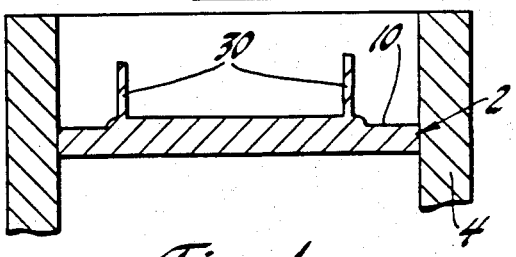
Fig. 1a PRIOR ART
Figure 2A:
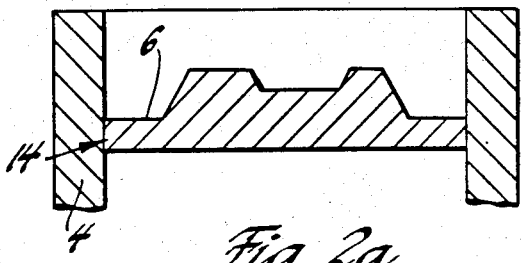
Figure 1B:
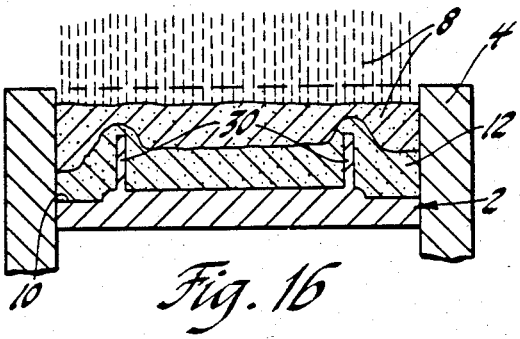
Figure 2B:
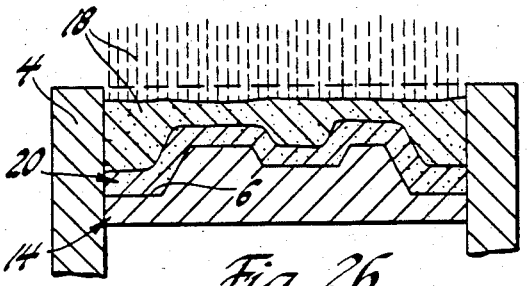
Figure 1C:
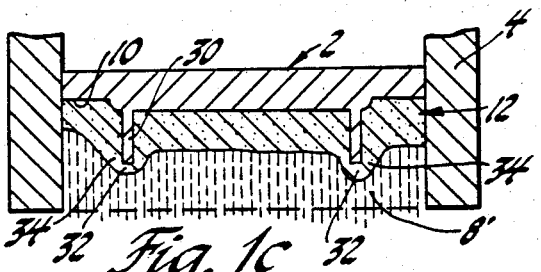
Figure 2C:
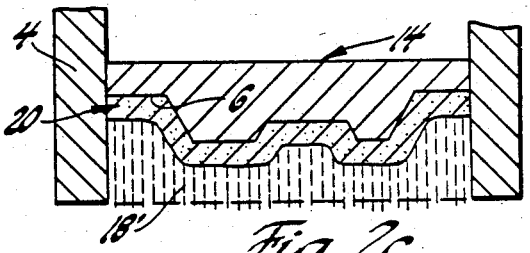
Figure 1D:
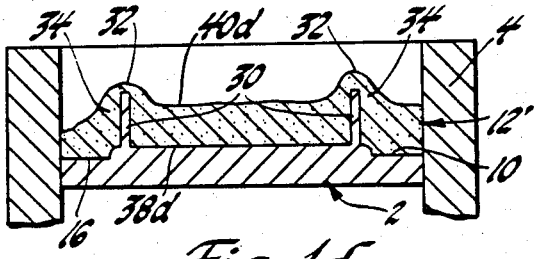
Figure 2D:
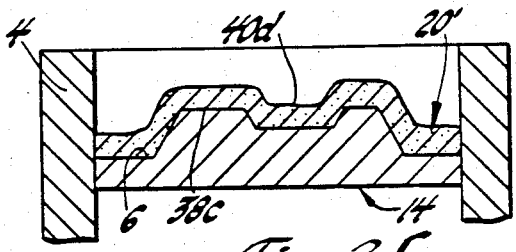
Fig. 2d PRIOR ART
Figure 6B:
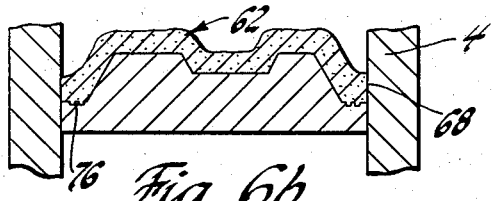
Figure 6A:
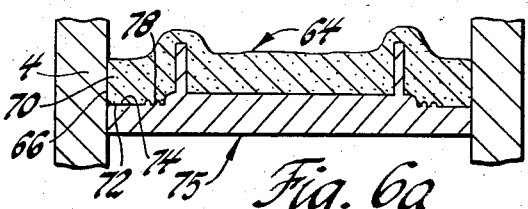
Figure 7:
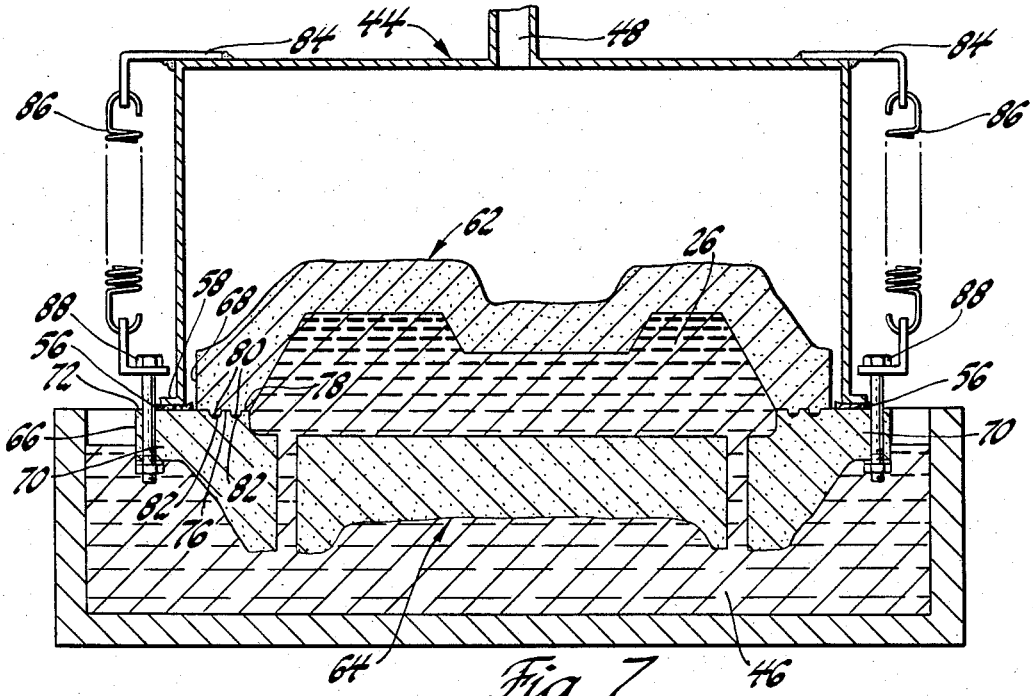

FIGS. 6*a* and 6*b* are views comparable to FIGS. 1*d* and 2*d* respectively but for shell mold halves formed in accordance with the present invention; and FIG. 7 illustrates a sectioned, side elevational view of a mold according to the present invention, assembled from the halves of FIG. 6, coupled to a vacuum chamber and immersed in melt.

BRIEF DESCRIPTION OF THE INVENTION

The present invention comprehends a self-supporting, resin-bonded-sand, counter-gravity casting shell mold having a gas-permeable cope sealed to a drag which is so formed as to provide a sealing surface not only for mating w:th the cope but also for mating directly with the vacuum chamber and such as to locate the cope-drag parting line seal inside the vacuum chamber. The term, "shell mold": is used herein in the genertic sense of a thin-walled, resin-bonded-sand mold molded against, and generally conforming to, a shaping pattern wherein only the resin in close proximity to the pattern is hardened (e.g., cured, as by heat, catalysis, chemical reaction, etc.) to form the mold; and not in the restricted sense of thermosetting-resin-bonded sand molds. Hence as used herein the term "shell mold" applies to resin-bonded-sand molds of all sorts, regardless of the curing mechanism, and hence includes molds made by either the hot (i.e., thermosetting resin) or cold (i.e., catalysed resin) box methods. In accordance with the invention, the drag is molded larger than the cope in that it includes a flange which extends outboard the periphery of the cope at the parting line therebetween. The upper surface of the drag's flange is molded against the forming surface of the drag-shaping pattern at the same time that the remainder of the drag is molded and hence may consistently and reliably be provided with virtually any shape or contour without the need for a separate operation. During casting, the flange is secured directly to the vacuum chamber of the casting apparatus such that a seal is effected between the upper surface of the flange and the mouth of the chamber. As a result, the seal at the parting line between the cope and the drag is enclosed by the vacuum chamber thereby preventing infiltration of air into the mold via the parting line. Sealing faces on the cope and drag are glued one to the other to join the mold halves into a solitary mold and preferably including at least two glue-filled tongue-in-groove type joints circumscribing the mold cavity so as to provide a labyrinth seal to prevent escape of melt from the cavity into the vacuum chamber.

DETAILED DESCRIPTION OF ONE EMBODIMENT OF THE INVENTION

Figure 4:
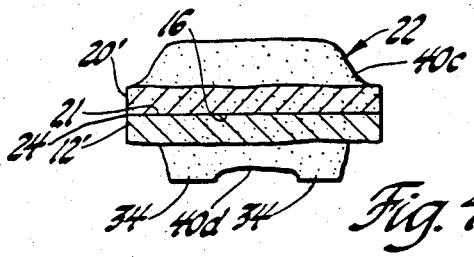
FIG. 4 is a view in the direction 4—4 of FIG. 3.

By way of illustration of a prior art method of making shell molds, FIGS. 1*a–d* and 2*a–d* depict the well known dump-box method of making shell mold halves from a mixture of sand and a thermosetting resin. FIGS. 1*a*–1*d* relate to molding the drag half while FIGS. 2*a*–2*d* relate to the cope half. The drag-shaping pattern 2 and the cope-shaping pattern 14 are positioned (see FIGS. 1*a* and 2*a*) in a box 4 and heated, by appropriate means (not shown), to a predetermined temperature sufficient to partially cure any resin in close proximity thereto. After the pattern 2 has been thusly heated, a mixture of sand and resin 8, 18 is applied (see FIGS. 1*b* and 2*b*) onto the upper surfaces 10, 6 of the patterns 2, 14 and allowed to remain there for a time sufficient for the resin in the sand layers 12, 20 adjacent the patterns 2, 14 to partially cure sufficiently to bind the sand in those layers together enough that the layers 12, 20 will adhere to the patterns 2, 14 when it is inverted in the next step of the process. Typically the thickness of the sand layers 12, 20 will range from about one-quarter inch to about three-quarters of an inch or more depending on the temperature of the pattern, the residence time on the pattern and the composition of the resin in the sand mixture. Following partial curing of the resin in the sand layers 12, 20, the boxes 4 are inverted and any loose sand and uncured resin 8', 18' falls away from the patterns 2, 14 (FIGS. 1*c* and 2*c*). Finally, the boxes 4 are returned to their upright positions (see FIGS. 1*d* and 2*d*) and the sand layers 12, 20 allowed to fully cure into rigid shells 12', 20' which conform generally to the shape of their respective patterns 2, 14. In this regard, the inside surfaces 38c and 38d (cope and drag, respectively) will conform substantially identically to the shaping surfaces 10 and 6 of the corresponding patterns while the outside surfaces 40c and 40d (cope and drag, respectively) are very rough and only approximate the shape of the pattern as best illustrated in FIG. 4.

Figure 3:
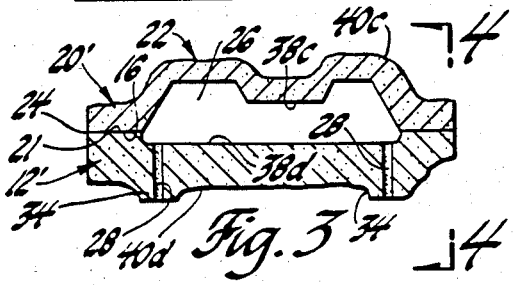
Fig. 3 PRIOR ART
FIG. 3 shows a sectioned, side elevational view of a prior art counter-gravity casting shell mold assembled from the halves formed by the method of FIGS. 1*a–d* and 2*a–d;*

A fully assembled mold 22 (see FIG. 3) is made by gluing the cope 20' and drag 12' together at the parting line 24. In this regard, an appropriate high temperature glue is applied to the sealing face 21 of the drag 12' and the glued face 21 clamped to the sealing face 16 on the cope 20' until the glue sets. A thermosetting glue such as the Georgia Pacific Co.'s SSG 10 has proven effective for this purpose. The glue is applied to the drag face 21 while it is still hot and the cope and drag immediately joined so that the heat therefrom cures the glue. Ingates 28 are provided in the underside of the drag 12' for admission of melt into the mold cavity 26. Such ingates 28 are simply formed when the drag is molded by providing a plurality of pins 30 on the drag shaping pattern 2 and mounding the sand thereabout. The peaks 32 of the sand mounds 34 formed about the pins 30 are cut off to open the ends of the ingates 28 to admit melt. Alternatively, the ingates 28 could be formed by drilling.

Figure 5:
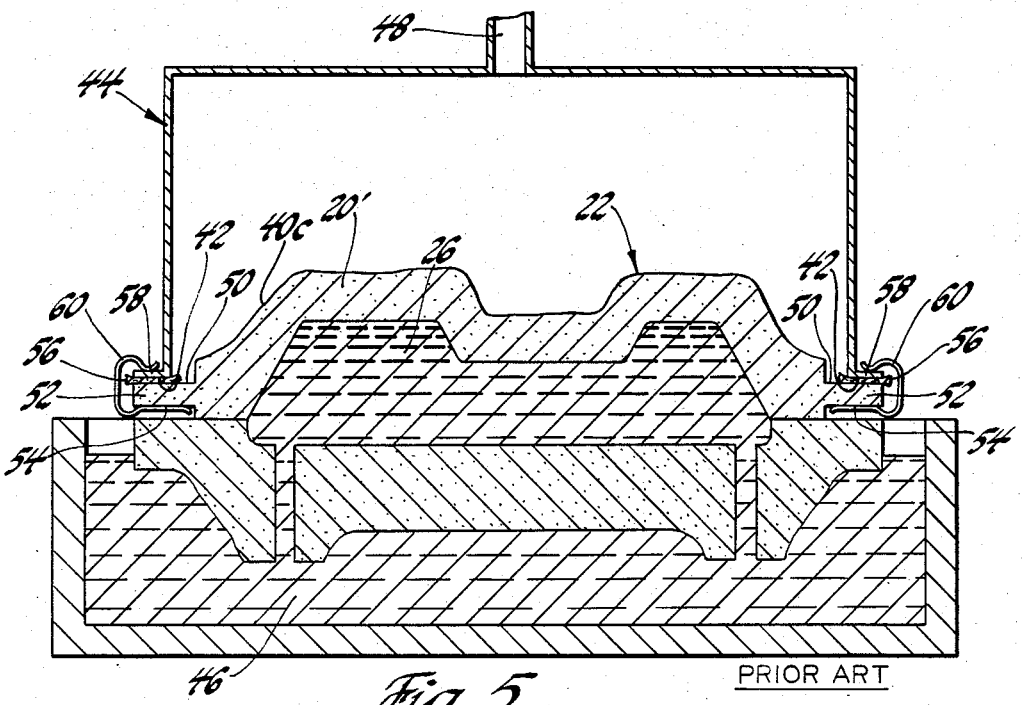
FIG. 5 illustrates a sectioned, side elevational view of a prior art shell mold (FIG. 3) modified for sealing, coupled to a vacuum chamber and immersed in melt.

FIG. 5 depicts the counter-gravity casting process of U.S. Pat. No. 4,340,108 wherein the mold 22 is sealed to the mouth 42 of vacuum chamber 44, immersed in a melt 46 and filled with melt by evacuating the chamber 44 through an appropriate outlet 48 therein. Because of the rough exterior of the cope 20', in the as-molded condition, it was not practically possible to obtain an adequate seal between the vacuum chamber 44 and the upper surface 40c. Accordingly, it was heretofore necessary to flatten the upper surface of the cope 20' to provide a sufficiently smooth surface 50 to seal with the mouth 42 of the vacuum chamber 44. The flat sealing surface 50 was formed by compressing the outer edge of the cope 20' to form a ledge 52 while it was still in a plastic condition, to form not only the flat upper surface 50 but an undercut region 54 as well, which may be used to secure the mold 22 to the vacuum chamber 44 via clips 60, or the like.

To insure against leakage passed any possible irregularities in the surface 50 and/or lip 58 of the vacuum chamber 44, a ribbon of compressible insulating material 56 may be positioned between the upper surface 50 and the flanged lip 58 of the vacuum chamber 44. One such ribbon material is marketed by the Carborundum Co. under the trade name Fiberfrax. The Fiberfrax ribbon 56 is about ⅛ inch thick, as received from the manufacturer, but compresses to about 1/16 inch when clamped between the mold 22 and the lip 58. As shown, the clips 60 engage the underside of the compressed ledge 52, at the undercut 54, as well as the top of the flanged lip 58 to compress the ribbon 56 and thereby effectively seal the cope 20 to the mouth 42 of the vacuum chamber 44.

FIGS. 6a and 6b depict a drag 64 and cope 62, according to the present invention, wherein the cope 62 is smaller than the drag 64 in the sense that when glued together the outer boundary 66 of the drag 64 extends beyond the periphery 68 of the cope 62 so as to provide a flange 70 which extends outboard the peripheral edge 68 of the cope 62. The surface 72 of the flange 70 is molded against the upper surface 74 of the drag pattern 75 at the same time the remainder of the drag 64 is formed. Hence, the surface 72 can be precisely shaped to whatever configuration is desired for sealing with the mouth of the vacuum box. Every drag so made will consistently have the same configuration/dimensions and all without the need for any additional handling, forming or machining operations. In the particular embodiment shown, the surface 72 is made flat and smooth for forming a butt seal with the mouth of the vacuum chamber 44. It is now possible for the vacuum chamber 44 to be sealed directly to the drag 64 such that the glue joint between the sealing faces 76 and 78 on the cope 62 and drag 64 respectively is contained within the vacuum chamber 44 so that no air can enter the mold cavity via the parting line therebetween when the chamber 44 is evacuated.

The mold cavity 26 will preferably be surrounded by a labyrinth seal to prevent escape of melt therefrom into the vacuum chamber 44. In this regard, the sealing face 76 on the cope 62 will include two or more continuous flat-topped beads 80 surrounding the mold cavity. At the same time, the sealing face 78 on the drag 64 will include continuous grooves 82 substantially complementary to the beads 80 and adapted to nest therewith. The bead 80 will be slightly smaller (i.e., by about 0.005 inch) than the groove 82 to permit glue in the groove to flow between the bead and groove surfaces. During assembly, a thermosetting glue (e.g., SSG 10) is applied to the surface of the hot drag 64 so as to fill the grooves 82 and adhere to the sealing face 78. Discontinuities in the glue adhering to the face 78 frequently occur and occasionally are sufficient to permit melt to escape therethrough. Filling the grooves 82 with glue eliminates the possiblity of such leaking. In this regard, when assembled, the flat-topped beads 80 redistribute the glue evenly in the bottom of the grooves to provide a substantially continuous belt of sealant around the cavity. Should there be any discontinuities in the belts, such discontinuities in one belt are so unlikely to be aligned with discontinuities in the other belt that a tortuous escape route is provided and a very effective seal achieved.

In addition to providing a sealing surface 78, the drag's flange 70 serves as a means to secure the drag 64 directly to the vacuum chamber 44. Brackets 84 welded to the top of the chamber 44 carry tension springs 86 depending therefrom. Bolts 88 which secure the flange 70 to the spring 86 in such a manner as to compress the sealing ribbon 56 and seal the mold in the mouth of the chamber 44.

While the invention has been described primarily in terms of a certain specific embodiment thereof, it is not intended to be limited thereto but rather only to the extent set forth hereafter in the claims which follow.

The embodiments of the invention in which an exclusive property or privilege is claimed are defined as follows:

1. Apparatus for shaping a metal article in a porous, bottom-gated, expendable, shell mold by the vacuum-induced, counter-gravity casting method wherein the mold is immersed in an underlying melt of said metal and evacuated to draw said melt up into said mold, said apparatus comprising:

a cope portion of said mold comprising a gas-permeable, resin-bonded-sand shell formed by molding against a cope-shaping pattern, said cope portion defining a mold cavity for shaping said article and having a peripheral edge defining a first sealing face on the underside of said cope portion between said edge and said cavity;

a drag portion of said mold comprising a resin-bonded-sand shell formed by molding against a drag-shaping pattern, said drag portion further defining said cavity and having a second sealing face on its topside surrounding said cavity;

an adhesive bonding and sealing said first and second sealing faces one to the other at a parting line therebetween;

a flange on said drag portion extending outboard said second sealing face beyond said peripheral edge, said flange having a substantially flat upper surface formed against said drag-shaping pattern at the time said drag portion was molded;

a vacuum chamber atop said drag portion but enclosing said cope portion, said chamber having a lip on its underside sealingly engaged with said upper surface of said flange; and means for evacuating said chamber sufficiently to draw said melt up into said porous mold when it is immersed in said melt.

2. Apparatus according to claim 1 wherein: a substantially continuous, integral, flat-topped bead of said resin-bonded-sand is molded integrally with at least one of said sealing faces so as to surround said cavity; a substantially continuous groove is molded into the other of said faces so as to surround said cavity; said bead and groove mate one with the other in tongue-in-groove fashion so as to provide a narrow space between the flat top of said bead and the bottom of said groove; and said adhesive substantially fills said space to substantially prevent escape of said melt from said cavity into said chamber via said parting line during casting.

3. Apparatus according to claim 2 wherein said sealing faces include at least two said beads and grooves surrounding said cavity.

4. Apparatus for shaping a metal article in a porous, bottom-gated, expendable shell mold by the vacuum-induced, counter-gravity casting method wherein the mold is immersed in an underlying melt of said metal and evacuated to draw said melt up into said mold, said apparatus comprising:

a cope portion of said mold comprising a gas-permeable, resin-bonded-sand shell formed by molding against a cope-shaping pattern, said cope portion defining a mold cavity for shaping said article and having a peripheral edge defining a first sealing face on the underside of said cope portion between said edge and said cavity;

a drag portion of said mold comprising a resin-bonded-sand shell formed by molding against a drag-shaping pattern, said drag portion further defining said cavity and having a second sealing face on its topside surrounding said cavity;

means for sealingly engaging said first and second sealing faces one to the other at a parting line therebetween;

a flange on said drag portion extending outboard said second sealing face beyond said peripheral edge, said flange having a substantially flat upper surface formed against said drag-shaping pattern at the time said drag portion was molded;

a vacuum chamber atop said drag portion but enclosing said cope portion, said chamber having a lip on its underside sealingly engaged with said upper surface of said flange; and means for evacuating said chamber sufficiently to draw said melt up into said porous mold when it is immersed in said melt.

* * * * *